US008125329B1

(12) United States Patent
Hirou

(10) Patent No.: US 8,125,329 B1
(45) Date of Patent: Feb. 28, 2012

(54) IDENTIFICATION SYSTEM

(76) Inventor: Timothy L. Hirou, Newport Beach, CA (US)

( * ) Notice: Subject to any disclaimer, the term of this patent is extended or adjusted under 35 U.S.C. 154(b) by 1721 days.

(21) Appl. No.: 11/248,091

(22) Filed: Oct. 12, 2005

(51) Int. Cl.
*G08B 23/00* (2006.01)

(52) U.S. Cl. ..... 340/527; 358/474; 358/482; 358/483; 358/1.15; 348/E7.085; 340/531; 340/536

(58) Field of Classification Search ..... 358/474, 358/482, 483, 1.15, 1.16; 340/527, 531, 340/506, 534, 310, 541, 572, 539.11; 348/E7.085, 348/143
See application file for complete search history.

(56) References Cited

U.S. PATENT DOCUMENTS 4,755,792 A * 7/1988 Pezzolo et al. ..... 340/538
6,076,080 A * 6/2000 Morscheck et al. ..... 705/400
6,211,783 B1 * 4/2001 Wang ..... 340/506
6,542,077 B2 * 4/2003 Joao ..... 340/426.16
6,720,874 B2 * 4/2004 Fufido et al. ..... 340/541
6,801,907 B1 * 10/2004 Zagami ..... 1/1
7,298,872 B2 * 11/2007 Glisson ..... 382/115
7,397,363 B2 * 7/2008 Joao ..... 340/539.11
7,539,874 B2 * 5/2009 Waterland ..... 713/183
7,826,464 B2 * 11/2010 Fedorov ..... 370/401
2002/0143938 A1 * 10/2002 Alexander et al. ..... 709/224
2003/0071724 A1 * 4/2003 D'Amico ..... 340/506
2003/0210139 A1 * 11/2003 Brooks et al. ..... 340/531
2004/0257208 A1 * 12/2004 Huang et al. ..... 340/426.1
2005/0284931 A1 * 12/2005 Adams et al. ..... 235/382
2006/0001537 A1 * 1/2006 Blake et al. ..... 340/521
2006/0181402 A1 * 8/2006 Martin et al. ..... 340/506
2006/0187024 A1 * 8/2006 Azimi et al. ..... 340/539.1
2008/0165788 A1 * 7/2008 Fedorov ..... 370/401

* cited by examiner

*Primary Examiner* — Negussie Worku
(74) *Attorney, Agent, or Firm* — William G. Lane

(57) ABSTRACT

An identification system comprising a controller; a camera system controlled by the controller; an entry detector system connected to the controller and providing an entry signal to the controller upon detection of an entry or the detection of a presence near the identification system; and an identification data entry system connected to the controller for one or more persons to enter identification data into the identification system upon entry into a structure and optionally upon egress from the structure.

21 Claims, 2 Drawing Sheets

IDENTIFICATION SYSTEM

FIELD OF THE INVENTION

The present invention is directed to an identification system. More particularly, it is directed to an identification station which can be mobile or permanent. Even more particularly, the present invention is directed to mobile and permanent standalone identification system and station.

BACKGROUND OF THE INVENTION

Although the world has seen great advances in science, medicine, political freedom, and individual freedoms over the last two hundred years, there also has been a sharp decrease in moral values and ethical values. This decrease in values is seen throughout the world in all walks of life, in all professions, in all genders, and in all ages. This decrease in moral values and moral judgment started in the 1960's and has accelerated when the youths of this world looked cynically at double standards. They viewed corrupt practices, or dictators, politicians, and business leaders, and the lack of enforcement of laws, especially drug laws, against celebrities, stars, and politicians. They have been taught that there is a double standard with respect to morals and ethics, one standard is employed for business and political leaders, the wealthy, celebrities, and politicians, and a second standard for the average citizen. The decline of moral standards and values is happening throughout society and throughout the world and is reflected in student cheating, white-collar crimes, tax evasion, felonious acts, terrorism, genocide, and the like.

There was a time in the not too distant past when virtually anywhere in the world, a person could leave their home without locking it up, without fear or concern that someone would enter the home without permission. In the past, people had more respect for another person's life and limbs, and property. This is clearly not the case today. In the first quarter of 2005, a young girl in the State of Florida, in the United States, was abducted from her home at night and brutally sexually assaulted and suffocated death. It was her family's policy to leave the house unlocked at night. Fortunately, most criminal acts involving entry into a home or building do not involve such brutal criminal acts. Most homes are entered for the primary purpose of theft.

Professional thievery rings exist throughout the world. One of the standard procedures of such rings is to first case the house or building to determine if it contains possessions worth stealing and then making an inventory of what is worth stealing. The rings keep catalogues of the contents of selected homes, normally the homes of the wealthy, and to a lesser extent, the contents of buildings or office or professional suites in a building. These theft rings frequently operate on a supply and demand system. An intermediary between a non-criminal purchaser and a thievery ring receives an order for a special work of art, jewelry, a selection of furs, a computer system, and the like. Frequently, the homes of the wealthy are surveilled when the home is opened for an architectural or artistic tour. Homes, buildings, suites, are surveilled when the home, building, or suite is opened up for lease or sale, or services.

Besides the elaborate thievery rings, there is also a theft of opportunity. An individual or group goes through a home that is open for sale or lease, one or members of the group see something they like, the other member[s] of the group distract the agent escorting them through the home while one member of the group secrets the desired article into their clothing or a large handbag, or the like. The group leaves the home with the purloined article[s].

Many large buildings have elaborate security systems, including numerous cameras to photograph people entering and egressing the building from many different directions, optical or electronic card scanners, keypad code entry devices, fingerprint identification devices, etc., and maintain a record of comings and goings for a predetermined period, such as a month or two months, or the like. Many homes of the very wealthy also have very elaborate security systems. However, even elaborate security systems do not necessarily have identification systems. Most buildings and most offices and suites and the homes of the great majority of people do not have such elaborate security systems.

There is a need to have an identification station which is a standalone mobile station which can be utilized to keep a record of the identification of people and their comings and goings of people into a suite, into a building, and/or into a home on a regular basis or for a special occasion, such as a large party, showings by real estate agents for sale or lease of the structure, art and architectural tours, and the like. What is needed is a system and station where a permanent or temporary record of the identity of people entering and leaving the structure can be made, such as a photographic record, a record of their identification, and a voice record, or the like. The records or recordings are maintained in the mobile station and/or at a remote location via hardwire, wireless, and/or satellite.

It is an object of the present invention to provide an identification system and station. It is a known fact that when the identification of a person is recorded, they are far less likely to commit a criminal act at that location because they recognize that an identification record would give the authorities a lead to them if any criminal act was committed at or on the location.

In many structures, such as corporate headquarters, corporate structures, government structures, and the like, the comings and goings of people into the structure are monitored and controlled by a receptionist, guard, or the like. This is cost effective for a large building or for a large well-funded organization. However, for most structures, this would be an outrageous cost that could not be justified. Accordingly, there is a need to have an identification station which would control entry into and, in certain situations, exit out of a structure. The present invention is a system that can be communicated with by a person[s] to request entry and/or exiting out of a structure which would include communication of identification data to the system, which upon verification of the identification data, would permit entry into the structure or exiting the structure by unlocking the entry door or exit door.

SUMMARY OF INVENTION

The present invention is directed to a system to detect entry into a structure and recording personal identification data of the party entering the structure. The identification data can include a photographic record of people entering, and optionally leaving, a structure, office, suite, and the like, and/or photographed, scanned in, enter audibly, and/or entered by keyboard or PDA. The system comprises a controller for controlling operation of the system and activating and deactivating components of the system; an entry detector connected to the controller; a camera connected to the controller; a recorder for the camera and/or personnel identification data connected to the controller; and a data entry module for entry of personal identification data ("PID" herein) connected to the controller.

In one embodiment of the identification system of the present invention, the system comprises a controller; a camera system controlled by the controller; an entry detector system connected to the controller; and an identification data entry system connected to the controller.

Conveniently, the controller for the system can be a CPU, such as a desk top computer, a laptop computer, or a small hand-held type computer. A desk top computer is conveniently used because of its relatively low cost, and the large number of ports it offers. Although desk top computers are not as small at laptop computers, they have shrunk in size considerably since the 1990's.

The system preferably includes an external communication module connected to the controller and adapted to be connected to and in communication with an external communications link, such as a telephone system (land line or cellular), a cable system, a satellite service system, a wireless transmission and/or reception system, and the like (collectively, "an external communication link").

A party, via the external communications link, can request entry into the structure through the system. In one embodiment, the system will control the entry/exit door structure. The requester will furnish identification. The system will verify the identification and if the identification is verified, will open the door or permit the door to be opened for to entrance or egress. In another embodiment where the entrance is not controlled, that is the entrance is not locked or unlocked by the system, the system will give an alarm if the requester makes an entrance into the structure without the requester putting in the necessary identification information, or the identification data is false, or otherwise cannot be verified. By verification identification data, it is meant that the system verifies that the entered identification data is the data for an authorized person to enter the structure. In the lower levels of the system, the system will not attempt to verify that the requester is the rightful possessor of the identification data. In the higher level systems, the system can incorporate iris readers, fingerprint detectors and voice recognition systems, and the like, to verify that the requester is the rightful possessor of the identification data. The locking device for the entry/exit can be a mechanical electrical device controlled by the system. The system can communicate with the locking device either by wireless means or by hardwire means. For temporary systems, the lock will be secured to the entry/exit door or will be a replacement for the existing lock system of the door. Many structures already have electrically powered door locks and many homes, mainly the homes of the very wealthy, have electronic door lock systems which are activated by smart cards and/or codes entered by keypads, or the like.

The requester can make the request to have entry into the structure or exit out of the structure via the external communications link. They can employ cell phones or land line phones, they can employ special door openers, such as wireless or keypad door openers used for garage doors, they can communicate via touch pad device which is connected to the system either by hardwire or by wireless connection, and the like. In one embodiment, the signal device can send and receive data or signals from the system and vice versa in order that the requester may make the request to enter or egress and respond with identification data as requested by the system. In addition to identification data, the system may also require code[s].

The entry detector signals the controller when an entry into the area under surveillance by the system is made. The controller, upon receiving the signal from the entry detector, activates the camera, the recorder and optionally other components described herein.

The entry detector can comprise a device for detecting the opening and/or closing of a door; a device for detecting the opening and closing of a window; a motion detector to detect motion; a pressure sensor, normally located under a carpet or a specially built floor section; an audio detector that can pick up sounds and distinguish them from the background sounds; a photocell-type detector that detects when a beam of light is broken between a light source and a light sensor; and/or a building security system containing devices or components which can detect entry into, and/or the egress from, and/or presence within a building.

The camera of the system can comprise a video camera or digital camera which is connected to and activated and deactivated by the controller. The system can also preferably include at least one light source for at least partially illuminating the scene covered by the camera. The light source is activated when the camera is activated to provide sufficient light for the camera to pick up images. The camera will be connected to a recorder, such as a digital recorder or a video recorder, to record what the camera sees. The recorder can be part of the camera or a separate device. The system can also include an audio detector and/or receiver which will be activated when the camera is activated. The camera is deactivated when the entry detector indicates egress out of the building; or does not detect the presence of someone within a structure as described herein.

The system can also include an audio pickup, such as a microphone to pick up audio, such as voices, and/or noise. The sounds picked up will be recorded by an audio recorder or the digital or video recorder.

The data entry module and identification data entry system can be a keyboard connected to the controller for entering information or via a device such as PDA, a flash card to connect to a controller port, such as a USB port, an optical or electromagnetic scanner, and/or an audio transponder. When a data entry module, such as a keyboard is employed, preferably an optical display is positioned near the keyboard and visible from the keyboard to aid in the entry of information. The camera also can be an optical scanner which permits a person to have identification cards, such as business cards, driver's licenses, or the like, optically scanned and recorded in the system. The data entry module can be a scanner for reading a smart card or optically recording a business card, or the like Preferably the system also includes an audio speaker connected to the controller to prompt for the entry of PID into the system employing the camera, the data entry module, and/or audio pickup. If an optical display connected to the controller is also employed in the system, a visual prompt can also be displayed on the optical display to prompt entry of information into the data entry module. Upon the entry of the PID, the controller can optionally turn the camera and/or audio pickup to off or sleep modes.

In one embodiment of the present invention, there will be a live voice connection for an off site control station via telephone, cellular, satellite, cable, or Internet connection, such as voice over IP technology known as VoIP. Upon confirmation of the identity of the person using the live voice connection, the remote control center can give access to the property by remotely locking or unlocking the entry door, or authorize entry by other means. The door can be fitted with a special mechanism to control the locking and unlocking.

The system can also include a card scanner which can scan a scanner card which identifies the person issued or bearing the card. Conventional card scanners known to the art can be employed. Many real estate agents have a smart card, such as General Electric's Supra Smart Lock coded digital keypad card. In addition, the system can include a scanner mounted on the outside which either is hardwired or has a wireless connection with the identification system that can scan a business card, such as a business card of the real estate agent. A business card can have a special coding, which when recognized by the system, can unlock the entry door.

A system can include a wireless transceiver connected to the controller and adapted to receive signals from an external transceiver for activation and/or deactivation of the system after identification of the external transmitter is confirmed by the transceiver. Activation of the system will comprise activating the controller, and optionally the camera and lamp, audio pickup, and the like. Activation can also comprise activation of the alarm system described below.

The system can also include a link to a telephone land line or cellular telephone station. The link is connected to the controller and adapted to receive coded or uncoded activation and/or deactivation signals from an external telephone source. The system can include a telephone connected to a land line, or a cellular telephone. When the system wishes to send a signal out, the controller can dial the appropriate telephone number and when the addressed telephone answers, sends a signal, which can include image signals from the camera, audio signals from the audio pickup, alarm signals, and the like, to the addressed telephone. The addressed telephone is preferably a central security station or office, a police or sheriff department, or the like. The system can also receive signals, including command signals, identification signals, from an external source via the telephone.

The system can also include a PDA or Smart Phone as an input device as well as a platform for displaying information via a wireless connection. It can also be used as a device to control the system's resources (i.e. door lock/door unlock device, printer, cameras, lights, etc.).

The system can also include an external communication link connected to the controller and adapted to be connected to and receive and transmit signals to and from an external communication system. The link can conveniently work through a modem. The external communication link can be a wireless transceiver; or a modem connected to a telephone line; or a cellular telephone service; or a cable system; or a satellite data transmission/reception system; and the like. The external communication link can also be connected to an external telephone system, either by a land line or by cellular phone service.

The system preferably includes an alarm system connected to the controller. Preferably the system will also include a tampering detector connected to the controller to detect unauthorized attempts to open the enclosure containing system components, such as the controller and recorder.

The identification system can be enclosed for security and/or esthetic purposes. For security purposes, the enclosure for the system can be any enclosure that is secured from casual entry or inspection. The enclosure can be lockable and will be preferably somewhat robust to prevent easy unauthorized entry into the enclosure and access to the system and the recorders. For esthetic purposes, the enclosure does not have to be secure, it only has to be attractive or hide the system from casual observation.

The system can be powered from a conventional electric power outlet, such as a 110/120-volt or 220/240-volt wall socket. Preferably the system will have a backup power supply within the system enclosure to power the system for at least several hours in the event of a external power failure. In a preferred embodiment of the present invention, an external station interrogates the system on a scheduled periodic basis, such as every five minutes. The identification system sounds an alarm when the external station does not communicate and interrogate the system during the schedule, such as when an intruder has cut off power to the system and has successfully prevented communication by the system via the external communication. Upon a power failure, the system, if it has an external communication link, will communicate with a predetermined external source to advise of the power failure. The system can also have an internal power supply if an external source is not available or is severed. If the tampering detector detects attempts for unauthorized entry into the system enclosure, the systems that have external communication module will signal an external station that an attempt is being made to make an unauthorized entry or that an unauthorized entry has been made into the system cabinet. If the system employs a telephone land line or cable connection, someone attempting to enter into the cabinet could cut or disconnect the land line or cable as well as the external power source. If the system has an audio alarm, the alarm will sound. However, if the system employs a wireless or mobile phone service, the person[s] attempting to make an unauthorized entry will not be able to prevent communication of the unauthorized entry approach because the signal will be transmitted by the wireless system.

The alarm can emit silent electronic signals, and/or optical signals and/or audio signals. The selection of the appropriate alarm will depend upon the circumstances. In a large building, or any building for that matter, empty of people, the optical and audio alarms will have minimal value unless it is used to scare off the person attempting to make unauthorized entry or who has made an unauthorized entry.

The system can also include a facsimile machine connected to the controller and/or directly to the external communication line for sending and receiving documents.

The system can also include a printer connected to the controller for printing out documents, such as a document containing information entered into the system via the data entry module, and/or identification data entry system.

The system can also include an optical display, such as a monitor for viewing identification data entered into the data entry module and/or for interrogating the system.

The system can include an input port connected to the controller and adapted to be connected to an external computer or computer accessory, such as a Palm Pilot, a hand-held computer, a laptop computer, external hard drive, an external zip drive, an external read/write CD ROM drive, an external read/write DVD drive, a flash card, or the like. A typical input port would be a parallel port, serial port, USB port, Firewire® port, and the like.

The present invention is also directed to a method of collecting personal identification data comprising: detecting entry into, or presence in, a structure; activating a recorder such as a camera or audio pickup to record the unauthorized entry; visually and/or optically prompting the unauthorized entrant to sign in; and deactivating the recorder upon signing in or activating the security alert when no sign-in is made within a predetermined time of detection of the unauthorized entry. By "signs in" it is meant to enter and/or confirm identification.

The method preferably also includes detecting egress of a person[s] in a structure, activating a recorder to record the egress and visual or audio record of the person entering; prompting the person[s] making egress to sign out; and deactivating the recorder upon sign-out, or activating the security alert when there is no sign-out within a predetermined time of a detection of the unauthorized egress.

All the system's activity can be viewed in real time by an external station via the external communication link. If the system's activities are viewed in real time, it is still preferred that all system developed data be recorded within the system and/or at the remote location. Real time viewing can also be done by the asset owner, i.e. the owner of the home, building, or the like; a data center set up for viewing real time primarily for security purposes although it can be for other purposes; property managers who have a system to view real time, which can either be on a 7-day, 24-hour bases, or during daylight hours and/or night hours; project managers; law enforcement agencies who provide such services; and/or national security organizations, such as the Brinks security company.

DESCRIPTION OF THE INVENTION

Figure 1:
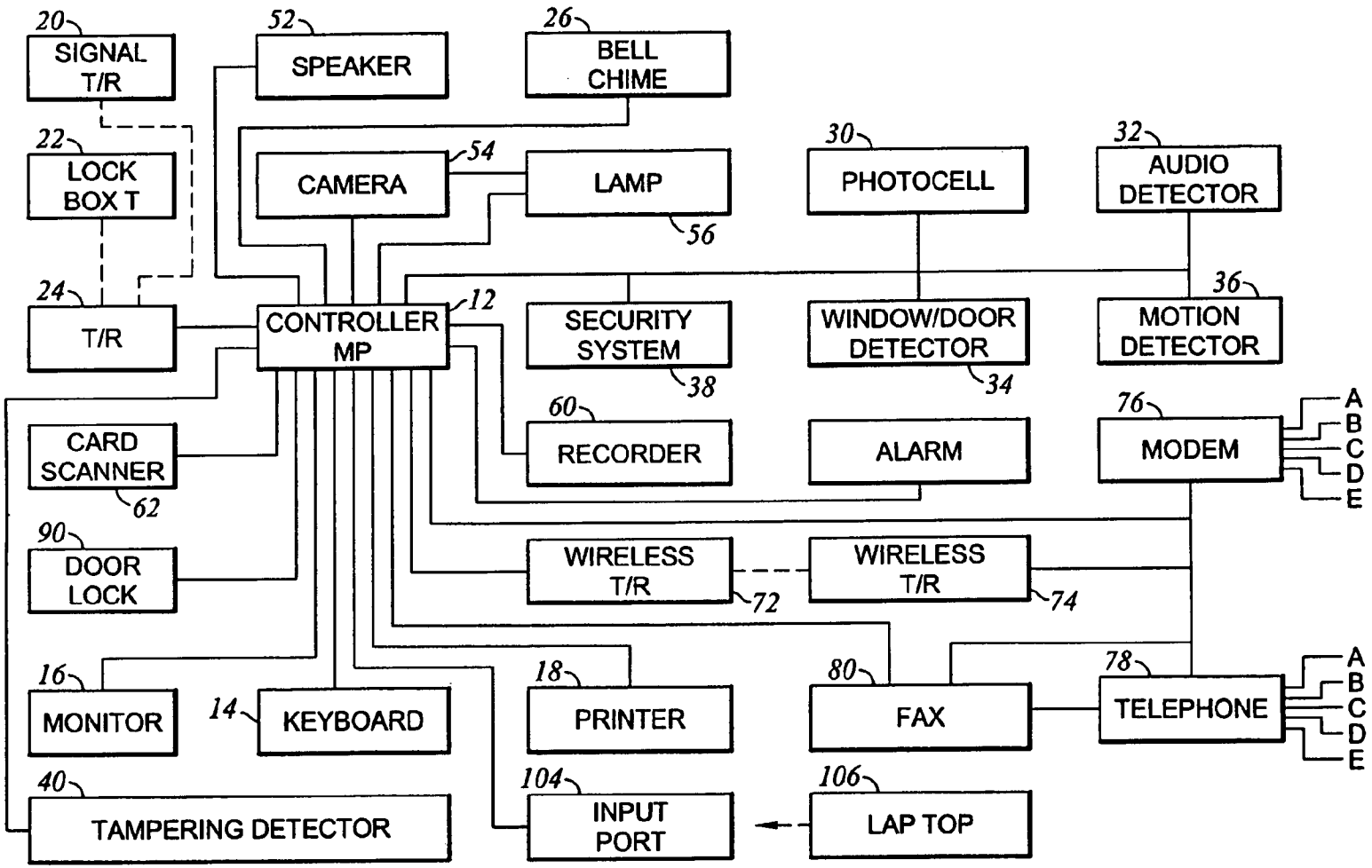
FIG. 1 is a block diagram of the system of the present invention.
Figure 2:
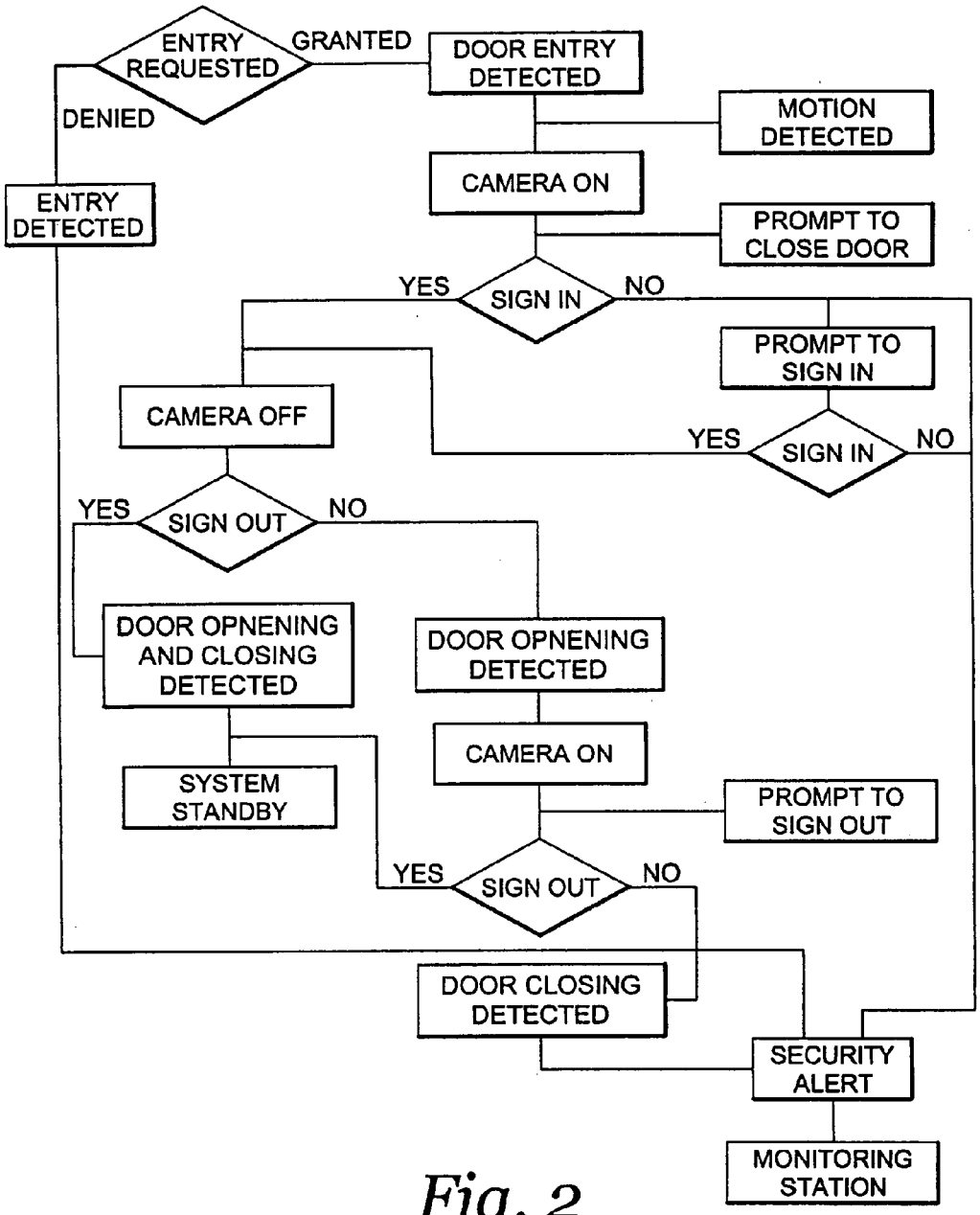
FIG. 2 is a flow diagram of the identification method of the present invention.

Referring to FIG. 1, the security system of the present invention comprises a controller 12, a recorder (described below) for storing identification data and information; a data entry module (described below) for entry of information into the system; and an entry detector (described below); and an external communication link (described below). The controller preferably has a microprocessing unit, conveniently connected to a keyboard 14, a monitor 16, input port 104, and, optionally, a printer 18. The microprocessor has an operating program to carry out the steps described herein. Modifications to the operating program can be made via the keyboard or optionally through the input port 104 which is adapted to be connected to other computers or computer accessories. When the system is employed, the controller 12 is always on, although the microprocessor may be in a pause mode or sleep mode to conserve electrical power. The system is activated by a signal from the entry detector, or a signal from an external source.

The entry detector is one or more devices used to detect entry into and/or out of the structure where the system is set up, and/or to detect a person in the structure, and/or when the system is being tampered with. The entry detector can be a photocell system 13, having a light emitter and a detector for the emitted, an audio detector 32, window and/or door opening and closing detectors 34, a motion detector 36, a tampering detector 40, and/or the structure existing security system 38. The system is employed in a structure and many structures have their own security systems which have photocells, audio detectors, or window/door opening and closing detectors, motion detectors, and the like. When the entry detector detects ingress into the structure, or movement within the structure, or sounds which are not part of the background sound of the structure, or detects deflection of a pressure detector, or detects tampering with system, the controller is activated by a signal from the entry detector to perform several functions. The controller can be activated by a signal from the audio detector 32 picking up the bell chime or doorbell or elevator chime or signal. In addition, the controller can be connected to a transceiver 24 which can receive signals from a lockbox 22 which has a transmitter. When the lockbox is opened, i.e. unlocked, or physically opened, to retrieve the key therein to open the door into the structure, the transmitter in the lockbox 22 sends a signal to the transceiver 24 which sends an activation signal to the controller 12. Optionally, authorized personnel may have their own transmitter 20 (or PDA or Smart Phone, or Smart Card) which can be activated outside or inside the structure to activate the system controller. The lockbox can also be connected to a remote central station via a telephone system (hardwire or wireless) or other communications link to give the central station notice of entry.

When the system is activated from a sleep mode, or otherwise, it activates camera 54. The system will have one or more cameras. The camera[s] can be mounted on the stand-alone mobile station or distributed strategically throughout the asset. In one embodiment of the present invention, camera 54 is secured on the cabinet (not shown) housing the system to face a particular scene, such as the entrance door to the structure or suite or room. The camera is directed to the door through which authorized egress and/or ingress is permitted. Preferably, the system will have at least one lamp 56 which will be activated when the camera is activated to illuminate the scene that the camera is viewing. The system can be connected to the asset's lighting system to activate and deactivate the asset's lighting system. The system can also be connected to electronic locks in the structure to lock up the structure and prevent entry. The camera can be a video camera or a digital camera. The camera is connected to a recorder, either directly or remotely, via the external communications link. The camera can also be a photographic film camera. When the controller receives a signal that the door is open, i.e. a signal from detector 34, a message is emitted from speaker 52 prompting the person[s] entering through the door to sign in. This prompt continues for a predetermined period at predetermined intervals, such as every ten seconds for ten minutes or until the sign-in procedure is completed. If the system employs a monitor 16, the monitor can also be signaled by the controller to visually display a similar prompting for the person[s] entering the door.

The system can be permanently employed or secured in a structure or it can be a mobile unit which can be moved from structure to structure and from place to place within a structure. The system can be housed in a secure enclosure to prevent unauthorized entry to the system. If the system includes an enclosure, the enclosure can be appropriately decorated to match the locale. In addition, the system can be incorporated in a structure that can blend into the surroundings so as not to be obvious, or it can be decorated to be quite obvious and/or authoritarian depending upon its desire use. If the system is to be utilized for house showing for sale or for lease, it is envisioned that the system would be employed in the entrance hall at the front door with the camera and lamp facing the front door. If the system is being employed in an office suite, it is envisioned that it would be employed in the lobby of the office suite with the camera and lamp aimed at the entrance to the suite. For a building, the system would preferably be employed at each entrance/exit to the building or structure including the elevator lobby where one or more elevators can exit to an external entrance/exit, such as a parking garage or the like.

In one embodiment of the present invention, the person[s] entering the structure can sign in by entering information, particularly identification information, into the controller via the keyboard. The monitor is helpful since it shows the person what is being entered. Alternatively, the person entering the building can have a coded card which can be scanned in the card scanner 62. The card would be coded to have identification information for at least one of the persons entering the building, such as a real estate agent or real estate broker. In one embodiment of the present invention, the audio prompter 52 and/or the visual prompter via monitor 16 would request each person entering the building to stand in front of the camera and show identification materials such as a driver's license or the like, which would be recorded by the camera. In addition, the person[s] can speak to the system to furnish information which will be recorded as audio information. If the system is connected to an external locale, such as a security office, or information recording locale, via the modem 76 or telephone 78, the information from the camera, audio recorder, and card scanner can be transmitted to the external locale for real-time review and/or archival storage. Preferably when the person[s] exits the building or structure, he or she signs out. the system can prompt for a sign out when the door is opened after sign in.

After the persons entering the structure has signed in, the camera and lamp, if used, can be optionally turned off by the controller at the end of a predetermined period. When a system employs a motion detector 36, the camera and lamp can be turned on when the motion detector detects motion near the system. At that point, the controller will signal the speaker 52 to prompt the people to sign out. If a monitor is employed, preferably there will also be a visual display prompting the people to sign out in a manner similar to the way they signed in. Prompting will normally be programmed to continue until the sign out is made or until the door is open and closed and no more motion is detected by the motion detector. If the parties do not sign out, and leave the structure, and the controller is connected to an outside station, such as a security station, the controller can signal an alarm signal via modem 76 or telephone 78 to signal that there has not been a sign out. Similarly, such a signal can be sent when people enter the structure and do not sign in or when the system detects a person in the structure who has not entered through an entry controlled or guarded by a system. Persons' entry or presence can also be detected by audio detector 32, one or more photocells 30, the motion detector 36, window and door detectors on the structure windows and other doors and/or on the structure's existing security system if it is hooked up the controller.

The controller or microprocessor has a clock and timer and can be programmed to put the system on full alert during off hours, such as from six in the evening until eight in the morning, or at other period when people normally do not enter a structure. Again, when an unauthorized entry is made through a door or when one of the detectors, such as the audio detector or the window detectors, detect unauthorized ingress or egress from the structure or the other detectors, such as a motion detector or pressure detector or photocells or audio detector, detect the presence of one or more persons in the structure at off hours, the system can prompt for entry of identification data and/or transmit an alarm signal. As mentioned, preferably the system is connected to an external security station either by modem 76 or telephone 78. The controller can send an alarm signal out to a security station notifying the station of the unauthorized entry or exit or presence. In addition to a cable or land line connection, the system can also employ a wireless connection, either a cellular or mobile phone system, or satellite wireless system, or a wireless transceiver 72 which communicates with a wireless transceiver that can be connected to the modem or the telephone. The modem 76 and/or the telephone 78 can be connected to a cable service; a telephone service; a satellite service; a wireless service; a microwave transmission service; and the like. The telephone service can be a land line service or a cellular service.

The system can be used on a permanent basis or on a temporary basis. When a structure is to be shown for sale or lease, it is envisioned that the system will be used on a temporary basis. When an owner of a structure has concerns about security of the structure, or when the owner of a business suite, a home, or the like, has concerns regarding the security, it would also be envisioned to be utilized on a temporary basis. However, the system can be permanently installed in a structure of a permanent fixture to record who enters and leaves the structure, the office, the home, or the like. If the structure, the office, the suite, the home, or the like, has more than one entrance, a system can be installed at each entrance and the systems can be tied in together, either by hard wire or by the wireless transceivers 72 and 74.

When the system is utilized for the sale or lease of an asset, such as a home or commercial building, the system for purposes of permitting entry into the asset will only respond to instructions, which would preferably include codes, to authorize individuals, such as licensed real estate brokers and agents. The system has the capability of furnishing real time views, audio, and the like, the remote receiving station can interrogate the individual desiring to enter the asset to determine if they are a licensed real estate broker or agent. Preferably, the remote receiving station will have a list either from the Internet or a hard copy that will list individuals with current real estate licenses. In this embodiment, the entry is preferably fitted out with a temporary entry lock which will prevent normal entry through the entry door by employing keys that are normally utilized to lock and unlock the entry door. The present system can be used in a number of embodiments. For example, the system can require that identification be confirmed, such as by voice recognition, recognition of an identification card, the opening of a lockbox. Once identification is recognized, the system can unlock the entry door and/or open the entry door. The system can also be employed whereby persons enter the structure through the entry door and confirm their identification by card scanning, business card scanning, coded business card scanning, voice recognition, fingerprint scanning, and/or facial scanning upon entry. If identification is not confirmed upon entry, the system has the ability to sound an alarm, and if external communications are hooked up with the central station, to notify the appropriate authorities of an unauthorized entry. In addition, the system can monitor at least a portion of the interior of a structure by motion detectors, and/or sound detectors, and/or camera surveillance of an unauthorized entry into the structure and send the appropriate alarm signal to the appropriate authorities assuming communications have been set up with a central station. Preferably when surveillance is undertaken by a camera, the camera is tied in with a motion detector and/or a sound detector.

In another embodiment of the present invention, a real estate agent or a real estate broker can perform the identification for entry by a cell or mobile phone, or by a transceiver, by entering their name and/or real estate license number. The system can run a check with the State authorities issuing real estate licenses via the external communication link to assure that the real estate agent or broker has a valid real estate license.

In another embodiment of the present invention, the system can control entry and egress of a structure by controlling the locking and unlocking of the entrance door into the structure. This can be carried out with a mechanical-electrical door lock temporarily secured to the door and connected to the controller 12 either by hardwire or by wireless communications. The requester, normally from outside of the structure, will request entry into the structure by communicating with the controller via the external communications link described above or by a dedicated wireless radio or signaling device for the system. Preferably, the controller will communicate with the requester and request identification data and/or a code. If a code is requested and a code is entered, the controller will verify that it is an authorized code. If identification data is requested and identification data is entered, the controller will verify the identification data. By verification of the identification data, it is meant that the controller determines that the identification data is that of an authorized person permitted to enter the structure. In some embodiments, if the person is authorized to enter and the entrance door is unlocked by the system, the person's likeness, voice, retina pattern, and/or fingerprint[s] may be recorded at the station to confirm that the requester is the person in rightful possession of the code and/or identification data. The door lock can be a temporary door lock specially fitted to the door for a particular purpose, or it an be permanently secured within the door. For safety purposes, especially fire safety, the door lock can be manually opened from the inside. The door lock will be of the normally locked typed. That is, the lock will in the locked position unless activated. Thus if there is a power failure, the door lock remains locked; however, anyone inside the structure may get out by manually opening the door from the inside.

The invention claimed is:

1. An identification system for a structure having at least one entry in and out comprising: a controller within the structure; a camera system including a camera controlled by the controller, the camera of the camera system within the structure and facing the structure entry; an entry, detector system connected to a structure entry and communicating detection of entry through the structure entry to the controller; an identification data entry system connected to the controller, the identification system having a visual and/or audio prompter to prompt for entry of identification data into the identification data entry system upon detection of, entry through the structure entry, the identification data not used to create an entry/identification badge; and a recorder to record data from the camera system the entry detection system, and the identification data entry system.

2. The identification system according to claim 1 wherein the camera of the camera system comprises a digital camera with a digital recorder.

3. The identification system according to claim 1 wherein the camera of the camera system comprises a video camera with a video recorder.

4. The identification system according to claim 1 wherein the camera system includes a lamp to light at least a portion of the area to be viewed by the camera of the camera system.

5. The identification system according to claim 1 wherein the entry detector includes a motion detector.

6. The identification system according to claim 1 including a transceiver connected to the controller, and the entry detector system comprising a lockbox with means to transmit a signal to the controller via the transceiver when the lockbox is opened.

7. The identification system according to claim 1 wherein the identification data entry system is a microprocessor: connected to a computer keyboard and a monitor, the microprocessor unit connected to the controller.

8. The identification system according to claim 1 wherein the identification data entry system includes a card scanner.

9. The identification system according to claim 1 wherein the identification data entry system includes an optical scanner.

10. The identification system according to claim 1 wherein the identification data entry system includes a microphone and audio recorder independent of the camera system connected to the controller for recording audio signals.

11. The identification system according to claim 1 including an external communication link connected to the controller.

12. The identification system according to claim 11 wherein the external communication link is a modem connected to telephone service, cable service, wireless service, or satellite service.

13. The identification system according to claim 1 wherein the controller and recorder are housed in a housing; the housing having a tampering detector mounted thereon connected to the controller to detect unauthorized entry into the housing.

14. The identification system according to claim 1 including an audio alarm connected to the controller; the controller activating the audio alarm in response to predetermined event.

15. The identification system according to claim 1 including a wireless transmission system connected to the controller and adapted to communicate with an external transceiver.

16. The identification system according to claim 1 including a recorder system connected to the identification data entry system and to the controller.

17. The identification system according to claim 1 wherein the identification data entry system comprises a PDA/SMART PHONE.

18. An entry identification system for a structure having at least one entry in and out comprising:

a controller within the structure;

a locking device on the entry to the structure that can communicate with and be controlled by the controller, communication device that can communicate with the controller and can command the controller to control the locking device and open same to permit entry into the structure by person[s] through the structure entry;

an entry detector system for detection of person[s] entering the structure through the structure entry, the entry detector system communicating with the controller; and an identification data system prompting for identification data from the person[s] entering the structure through the structure entry and collecting same, the identification data system connected to the controller, the collected identification data not used for creating an identification/entry badge.

19. The entry identification system according to claim 18 wherein the system includes a camera system controlled by the controller; and a recorder to record data from the camera system.

20. The entry identification system according to claim 19 including an entry detector system for the structure connected to the controller.

21. The entry identification system according to claim 19 wherein the camera system includes a lamp to light at least a portion of the area to be viewed by the camera of the camera system.

* * * * *